US005800059A

United States Patent [19]

Cooke et al.

[11] Patent Number: 5,800,059

[45] Date of Patent: Sep. 1, 1998

[54] STATIC FLUID FLOW MIXING APPARATUS

[75] Inventors: Jeffrey A. Cooke; Glen D. Austin; Michael Jerome McGarrity, all of London, Canada

[73] Assignee: Labatt Brewing Company Limited, London, Canada

[21] Appl. No.: 796,412

[22] Filed: Feb. 6, 1997

Related U.S. Application Data

[63] Continuation of Ser. No. 438,235, May 9, 1995, abandoned.

[51] Int. Cl.[6] ..... B01F 5/00

[52] U.S. Cl. ..... 366/337; 366/336; 138/40; 138/42

[58] Field of Search ..... 366/336–340; 138/37, 40, 42

[56] References Cited

U.S. PATENT DOCUMENTS

| | | | |
|---|---|---|---|
| 3,051,453 | 8/1962 | Sluijters . | |
| 3,190,618 | 6/1965 | Katzen | 366/337 |
| 3,235,003 | 2/1966 | Smith | 138/38 X |
| 3,337,194 | 8/1967 | Zavasnik et al. . | |
| 3,567,921 | 3/1971 | Holiday . | |
| 3,620,506 | 11/1971 | So . | |
| 3,652,061 | 3/1972 | Chisholm . | |
| 3,657,087 | 4/1972 | Scott . | |
| 3,733,057 | 5/1973 | Kahoun . | |
| 3,769,517 | 10/1973 | Coleman . | |
| 3,924,246 | 12/1975 | Scherer . | |
| 3,998,477 | 12/1976 | Delahaye et al. . | |
| 4,002,918 | 1/1977 | Graentzel . | |
| 4,034,965 | 7/1977 | King . | |
| 4,072,296 | 2/1978 | Doom | 366/337 |
| 4,093,188 | 6/1978 | Horner . | |
| 4,112,520 | 9/1978 | Gilmore . | |
| 4,136,720 | 1/1979 | Kinney . | |
| 4,179,222 | 12/1979 | Strom et al. . | |
| 4,296,066 | 10/1981 | Schenck . | |

(List continued on next page.)

FOREIGN PATENT DOCUMENTS

| | | |
|---|---|---|
| 63729 | 11/1982 | European Pat. Off. . |
| 0470518 A1 | 2/1992 | European Pat. Off. . |
| 539423 | 11/1931 | Germany . |
| 1807922 | 6/1969 | Germany . |
| 25509 | of 1909 | United Kingdom . |
| 1212633 | 11/1970 | United Kingdom . |
| WO 90/00929 | 2/1990 | WIPO . |

OTHER PUBLICATIONS

Braun, A.M. et al., *Photochemical Technology*, (Chichester, U.K.: John Wiley & Sons Ltd., 1991), Ch. 4, 152–201.

*Primary Examiner*—Patrick F. Brinson
*Attorney, Agent, or Firm*—Cammarata & Grandinetti

[57] ABSTRACT

A static mixer conduit comprises a longitudinally elongated conduit having tabs that are arranged with respective first edges adjacent the conduit wall, and respective opposed second edges that are spaced radially inwardly from the conduit wall. These tabs are operable as fluid foils so that with fluid flowing through the conduit, greater fluid pressures manifest against the tab's upstream faces relative to reduced fluid pressures against their downstream faces. The resultant pressure difference in the fluid adjacent, respectively, the mutually opposed faces of each of the tabs causes a longitudinal flow of fluid through the conduit over and past each said tab, to be redirected. As a result of that redirection, there is introduced a radial cross-flow component to the longitudinal flow of fluid through the conduit. In particular, the mixer further comprises a central body extending generally coaxially along at least a portion of the longitudinal extent of the conduit and defining between the central bodies surface and the conduit wall, an annular space confining the radial cross-flow. A method is also disclosed, which comprises static mixing, over a longitudinal extent of a mixing volume having an annular cross-section, wherein radial cross-stream mixing in a longitudinal fluid flow results from flow-redirecting tabs redirecting a longitudinal fluid flow from an outer, fluid containment boundary surface, across an intervening space having an annular cross-section towards an inner boundary surface.

6 Claims, 2 Drawing Sheets

U.S. PATENT DOCUMENTS

| | | | |
|---|---|---|---|
| 4,314,974 | 2/1982 | Libby et al. . | |
| 4,317,041 | 2/1982 | Schenck . | |
| 4,352,378 | 10/1982 | Bergmann et al. | 366/337 X |
| 4,363,552 | 12/1982 | Considine . | |
| 4,381,978 | 5/1983 | Gratzel et al. . | |
| 4,454,835 | 6/1984 | Walsh et al. . | |
| 4,476,105 | 10/1984 | Greenbaum . | |
| 4,488,935 | 12/1984 | Ruhe . | |
| 4,497,753 | 2/1985 | Streiff . | |
| 4,498,786 | 2/1985 | Ruscheweyh | 366/337 X |
| 4,544,470 | 10/1985 | Hetrick . | |
| 4,600,544 | 7/1986 | Mix . | |
| 4,747,697 | 5/1988 | Kojima . | |
| 4,774,026 | 9/1988 | Kitamori et al. . | |
| 4,808,007 | 2/1989 | King . | |
| 4,832,114 | 5/1989 | Yeh | 138/38 X |
| 4,863,608 | 9/1989 | Kawai et al. . | |
| 4,868,127 | 9/1989 | Blades et al. . | |
| 4,929,088 | 5/1990 | Smith | 366/337 |
| 4,957,773 | 9/1990 | Spencer et al. . | |
| 4,981,368 | 1/1991 | Smith | 366/337 |
| 5,045,288 | 9/1991 | Raupp et al. . | |
| 5,094,815 | 3/1992 | Conboy et al. . | |
| 5,126,111 | 6/1992 | Al-Ekabi et al. . | |
| 5,149,377 | 9/1992 | Esrom et al. . | |
| 5,330,267 | 7/1994 | Tauscher | 366/337 X |

STATIC FLUID FLOW MIXING APPARATUS

This application is a continuation of application Ser. No. 08/438,235, filed on May 9, 1995, now abandoned.

FIELD OF THE INVENTION

The present invention relates to static mixers, and especially to static mixers having both radial and longitudinal flow in an elongated fluid-mixing conduit.

BACKGROUND OF THE INVENTION

As a generalization, typical static mixers include fluid redirecting tabs, vanes, baffles or the like that are arranged in a fluid conduit, and which are typically operable to divide, subdivide, separate adjacent subdivided flows, and then recombine the subdivided flows into a "shuffled" whole, as the fluid passes through that conduit.

In a departure from that more typical approach, U.S. Pat. No. 4,929,088 discloses a tab arrangement in a fluid conduit that has lower fluid back pressures than are associated with the more typical approach to more typical static mixer designs. In particular, this patented tab arrangement operates by creating radial vortex flow patterns that are generally transverse to the longitudinal flow through the fluid conduit in which these tabs are mounted. This results in a plurality of cross-stream mixing flows that are transverse to the longitudinal flow of the fluid along the length of the conduit. This approach is disclosed as an enhancement over the kind of mixing that would be expected to naturally occur in a conduit under turbulent fluid flow conditions.

SUMMARY OF THE INVENTION

In accordance with the present invention there is provided a further improvement in static mixers—one in which a central elongated body is deployed within the static mixer conduit, in a central region of reduced mixing. Such a region, for example, tends to exist between diametrically-opposed, radially-convergent, cross-stream mixing flows within that conduit. In any case, this centrally-located body occupies a zone in which there would otherwise be a reduced cross-flow. The presence of this central body results in the fluid flowing past it tending to be more efficiently mixed—in that there is less of a tendency for an unmixed "channel" of longitudinal fluid flow to establish itself within the center of the conduit.

In a particularly preferred embodiment according to the present invention, there is provided a static mixer conduit in which tabs are each arranged with respective, (preferably leading, upstream) edges adjacent the conduit wall, and respective, (preferably trailing, downstream) opposed edges that are spaced radially inwardly from the conduit wall. These tabs are operable as fluid foils which, with fluid flowing through the mixer, have greater fluid pressures manifest against their upstream faces and reduced fluid pressures against their downstream faces. This pressure difference in the fluid adjacent, respectively, the mutually opposed faces of each of the tabs then causes the longitudinal flow over and past each tab to be redirected, thereby resulting in the addition of a radial cross-flow component to the longitudinal flow of fluid through the conduit.

The present invention further includes an improved method, in which the static mixing is performed over a longitudinal extent of a mixing volume having an annular cross-section. More specifically, the method of the present invention relates to cross-stream mixing in a fluid flow, in which tabs mentioned herein, redirect a longitudinal fluid flow from an outer, fluid containment boundary surface, across an intervening space having an annular cross-section towards an inner boundary surface. Preferably, the tabs are ramped and arranged in the fluid flow between the respective boundary surfaces, to cause the fluid to flow over the edges of each such tab to deflect the generally longitudinal fluid flow inwardly from the fluid containment boundary surface, across the intervening space (having the aforesaid annular cross-section), towards an inner boundary surface. The inner boundary surface defines a volume which but for the presence of that surface, would permit passage of a central longitudinal flow of non-uniform fluid mixing.

In a particularly preferred form the fluid flow over the edges of each tab results in the flow being deflected inward and up the inclined surface of the tab to generate a pair of tip vortices in the fluid flow past each tab. The vortices of each such pair have mutually opposed rotations, about an axis of rotation oriented generally along the longitudinal "stream-wise" fluid flow direction, along the annular space between the two boundary surfaces.

DETAILED DESCRIPTION OF A PREFERRED EMBODIMENT

Introduction of the Drawings

(Note: The apparatus disclosed and illustrated in U.S. Pat. No. 4,929,088—Smith, (dated Mar. 29, 1990), is useful as a component of the present invention, and the disclosure of that patent is hereby expressly incorporated herein, in its entirety. Similarly, the method described in U.S. Pat. No. 4,981,368—Smith, (dated Jan. 1, 1991) is also hereby expressly incorporated herein in its entirety.

Figure 1:
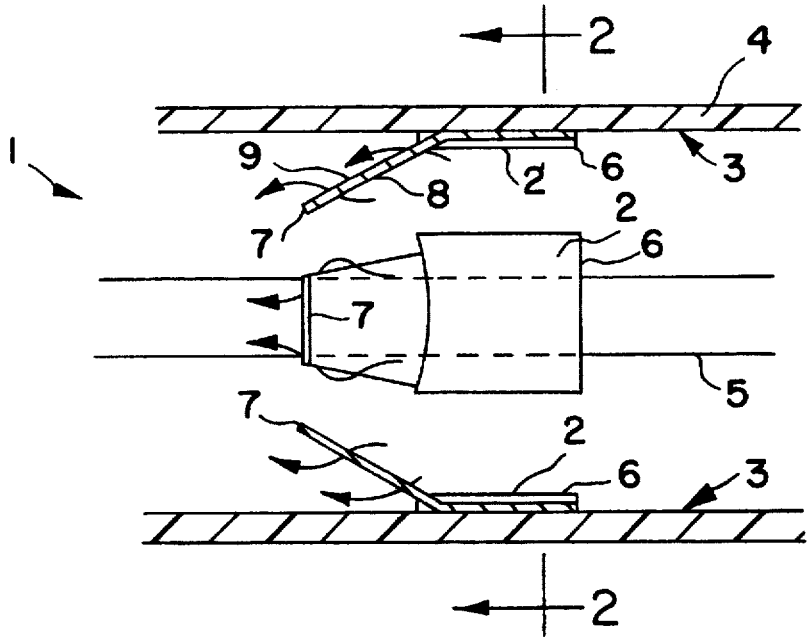
FIG. 1 is an elevated, longitudinal cross-section through a static mixer according to the combination of the present invention.
Figure 2:
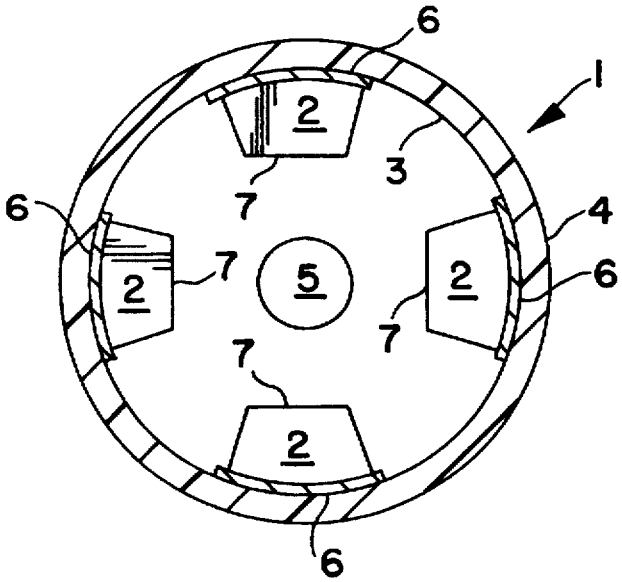
FIG. 2 is an elevated, transverse cross-section taken through line 2—2 of the mixer depicted in FIG. 1.
Figure 3:
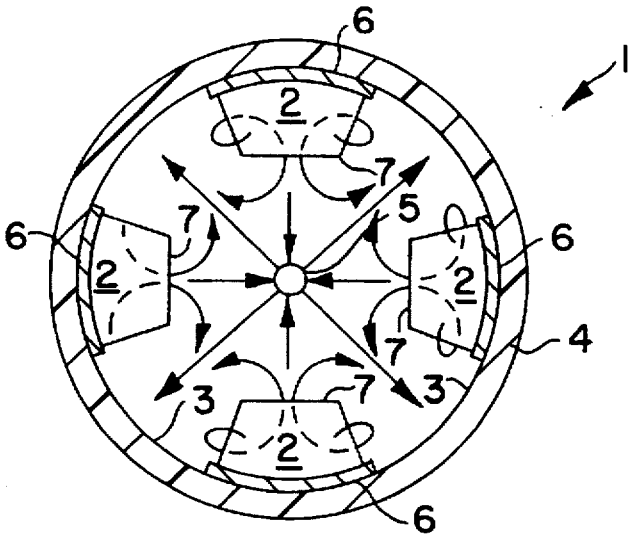
FIG. 3 is a reproduction of the view illustrated in FIG. 2, but further including representative fluid stream lines, to illustrate radial cross-flow patterns; and, FIG. 4 is a cut-away perspective view illustrating vortex flow downstream of a single, representative tab.
Figure 4:
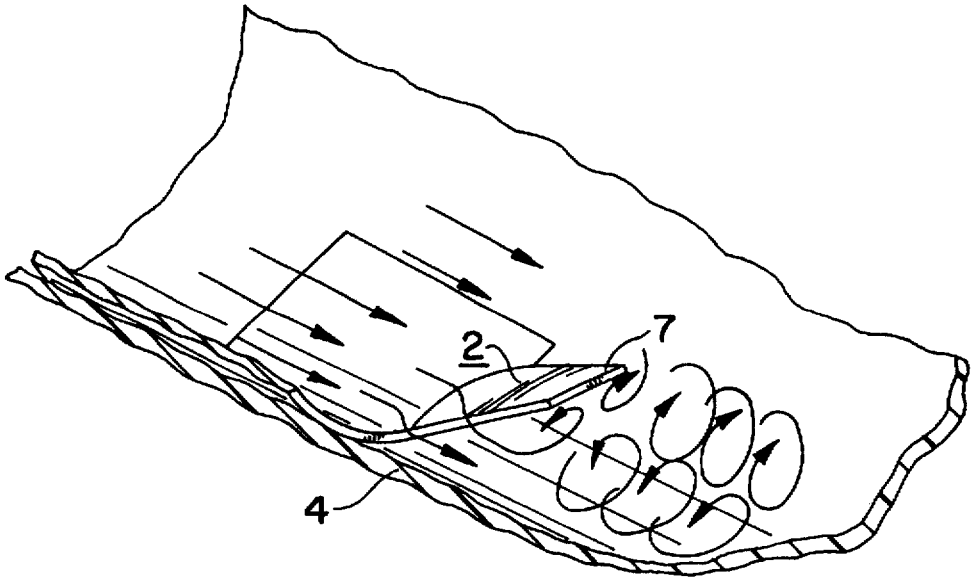

Referring now to FIGS. 1, 2 and 3, there is illustrated an embodiment according to the present invention, in which a static mixer 1, includes a series of tabs 2 that are secured to the side walls 3 of a conduit 4. A central body 5 is arranged in co-axially aligned relation, centrally within the interior of conduit 4, where it occupies a region of inefficient mixing.

In the illustrated embodiment, that region forms between diametrically-opposed, radially-convergent, cross-stream mixing flows (see FIG. 3, in particular) within conduit 4.

Static mixer 1 comprises conduit 4, in which tabs 2 are each arranged with respective, (leading, upstream) edges 6 adjacent the conduit wall, and respective, (trailing, downstream) opposed edges 7 that are spaced radially inwardly from the conduit wall 3. Tabs 2 operate as fluid foils which, with fluid flowing through the mixer, have greater fluid pressures manifest against their upstream faces 8 (see FIG. 1) and reduced fluid pressures against their downstream faces 9 (see FIG. 1). This pressure difference in the fluid adjacent, respectively, the mutually opposed faces of each of the tabs then causes the longitudinal flow over and past each tab to be redirected (as is illustrated by the various flow streamlines that are shown in the various figures), thereby resulting in the addition of a radial cross-flow component to the longitudinal flow of fluid through the conduit 4.

With body 5 occupying the zone of relatively poor mixing as described above, the fluid itself is precluded from forming eddies in that zone, in which the fluid would not be as thoroughly admixed with the balance of the fluid flow.

In a particularly preferred embodiment, body 5 comprises a heat transfer body, adapted to exchange heat with the fluid passing through the conduit. This allows an manufacturer to not only secure improved mixing as aforesaid, but to also increase the amount of heat exchange surface available to alter the temperature of the fluid flow. This is particularly advantageous since the benefit of avoiding boundary layer "insulation" effects as discussed in relation to the boundary surface described in U.S. Pat. No. 4,929,088, is true for both that boundary surface, and for the heat exchange surface of the central body 5.

In a further embodiment according to the present invention, the central body 5 is a cross-flow filter element. As will be apparent to persons skilled in the art, in light of the present invention, the boundary layer advantages associated with thermal transfer are applicable in achieving cross-flow filtration advantages too.

In operation, the improved static mixing according to the present invention is performed over a longitudinal extent of a mixing volume having an annular cross-section, located between the central body 5 and side walls 3 of conduit 4. More specifically, there is cross-stream mixing in the longitudinal fluid flow through the present apparatus, in which tabs 2 redirect a longitudinal fluid flow from the outer, fluid containment boundary surface of side walls 3, across an intervening space having an annular cross-section towards the inner boundary surface defining the outermost extent of central body 5. Preferably, tabs 2 are ramped and arranged in the fluid flow between the respective boundary surfaces of side walls 3 and central body 5, to cause the fluid to flow over the edges of each tab 2 to deflect the generally longitudinal fluid flow radially inwardly from the fluid containment boundary surface of side wall 3, across the intervening space (having the aforesaid annular cross-section), towards an inner boundary surface defined by the outermost surface of central body 5. The inner boundary surface of central body 5, circumscribes a volume which but for the presence of that surface, would permit passage of a central longitudinal flow of substantial, relatively non-uniform mixing.

In a particularly preferred form the fluid flow over the edges of each tab results in the flow being deflected inward and up the inclined surface of the tab to generate a pair of tip vortices in the fluid flow past each tab. The vortices of each such pair have mutually opposed rotations, about an axis of rotation oriented generally along the longitudinal "stream-wise" fluid flow direction, along the annular space between the two boundary surfaces.

We claim:

1. In a static mixer conduit comprising a longitudinally elongated conduit having tabs that are secured to the conduit wall and that are arranged with respective first edges adjacent the conduit wall, and respective opposed second edges that are spaced radially inwardly from the conduit wall, wherein said tabs are operable as fluid foils which, with fluid flowing through said mixer conduit, have greater fluid pressures manifest against their upstream faces and reduced fluid pressures against their downstream faces, and wherein a resultant pressure difference in the fluid adjacent, respectively, the mutually opposed faces of each of the tabs causes a longitudinal flow of fluid through said conduit over and past each said tab, to be redirected, thereby resulting in the addition of a radial cross-flow component to the longitudinal flow of fluid through the conduit, the improvement which comprises a central body extending generally coaxially along at least a portion of the longitudinal extent of said conduit and defining between said central body and said conduit wall, an annular space.

2. In a method comprising static mixing, over a longitudinal extent of a mixing volume having an annular cross-section, wherein radial cross-stream mixing in a longitudinal fluid flow results from flow-directing tabs redirecting a longitudinal flow from an outer, fluid containment boundary surface to which said tabs are secured, the improvement which comprises redirecting said longitudinal flow across an intervening space having an annular cross-section towards a motionless inner boundary surface.

3. The method according to claim 2, wherein said tabs are ramped and arranged in the fluid flow between the respective boundary surfaces, to cause the fluid to flow over the edges of each said tab to deflect the generally longitudinal fluid flow inwardly from the fluid containment boundary surface, across the intervening annular space towards said inner boundary surface.

4. The static mixer conduit of claim 1 wherein the central body comprises a heat transfer body adapted to exchange heat with the fluid passing through the conduit.

5. In a static mixer conduit comprising a longitudinally elongated conduit having tabs that are arranged with respective first edges adjacent the conduit wall, and respective opposed second edges that are spaced radially inwardly from the conduit wall, wherein said tabs are operable as fluid foils which, with fluid flowing through said mixer conduit, have greater fluid pressures manifest against their upstream faces and reduced fluid pressures against their downstream faces, and wherein a resultant pressure difference in the fluid adjacent, respectively, the mutually opposed faces of each of the tabs causes a longitudinal flow of fluid through said conduit over and past each said tab, to be redirected, thereby resulting in the addition of a radial cross-flow component to the longitudinal flow of fluid through the conduit, the improvement which comprises a motionless central body, comprising a cross-flow filter element, extending generally coaxially along at least a portion of the longitudinal extent of said conduit and defining between said central body and said conduit wall, an annular space.

6. In a method comprising static mixing, over a longitudinal extent of a mixing volume having an annular cross-section, wherein radial cross-stream mixing in a longitudinal fluid flow results from flow-directing tabs redirecting a longitudinal flow from an outer, fluid containment boundary surface, wherein said tabs are ramped and arranged in the fluid flow between the respective boundary surfaces, to cause the fluid to flow over the edges of each such tab to deflect the generally longitudinal fluid flow inwardly from the fluid containment boundary surface, across the intervening annular space towards said inner boundary surface, wherein the fluid flow over the edges of each said tab results in the flow being deflected inwardly and upwardly along an inclined surface of each said tab, to thereby generate a pair of tip vortices in the fluid flow past each tab, and wherein said vortices associated with each said pair have mutually opposed rotations about an axis of rotation oriented generally along the longitudinal "stream-wise" fluid flow direction, along the annular space between said two boundary surfaces, the improvement which comprises redirecting said longitudinal flow across an intervening space having an annular cross-section towards a motionless inner boundary surface.

* * * * *